US006490863B1

(12) United States Patent
Simonds

(10) Patent No.: US 6,490,863 B1
(45) Date of Patent: Dec. 10, 2002

(54) COMPRESSOR CYCLE APPARATUS

(75) Inventor: Edward L. Simonds, Adel, IA (US)

(73) Assignee: Thermal Dynamics, Inc., Adel, IA (US)

( * ) Notice: Subject to any disclaimer, the term of this patent is extended or adjusted under 35 U.S.C. 154(b) by 0 days.

(21) Appl. No.: 09/878,745

(22) Filed: Jun. 11, 2001

(51) Int. Cl.[7] ..... F01K 7/34
(52) U.S. Cl. ..... 60/691; 60/692
(58) Field of Search ..... 60/690, 691, 692, 60/693

(56) References Cited

U.S. PATENT DOCUMENTS 2,463,155 A 3/1949 Dawes
3,804,562 A 4/1974 Hansson
4,347,705 A * 9/1982 Mirante ..... 60/693 X
4,553,396 A * 11/1985 Heizer ..... 60/693 X
4,628,212 A * 12/1986 Uehara et al. ..... 290/54
4,789,317 A 12/1988 Waser et al.
5,284,427 A 2/1994 Wacker
5,501,586 A 3/1996 Edwards
5,533,566 A 7/1996 Fineblum
5,548,958 A * 8/1996 Lewis ..... 60/693
5,816,789 A 10/1998 Johnson
5,961,310 A 10/1999 McClure
6,024,549 A 2/2000 Lee
6,233,941 B1 * 5/2001 Youssef ..... 60/693 X

* cited by examiner

*Primary Examiner*—Hoang Nguyen
(74) *Attorney, Agent, or Firm*—Brett J. Trout

(57) ABSTRACT

A condensation apparatus comprising a fluid and means for changing said fluid from a liquid to a pressurized gas. Means are provided for condensing a portion of said pressurized gas to a first quantity of said liquid, and for deriving work from said pressurized gas as said pressurized gas condenses to said first quantity of said liquid.

20 Claims, 9 Drawing Sheets

COMPRESSOR CYCLE APPARATUS

BACKGROUND OF THE INVENTION

1. Field of the Invention

The present invention relates in general to a compression cycle apparatus for deriving work from the expansion of a heated fluid and, more specifically, a compression cycle apparatus having increased efficiencies associated with greater conversion of a fluid from a gas to a liquid, and diversion of the resulting liquid away from the prior art condensation system.

2. Description of the Prior Art

Compression cycle apparatus are well known in the art, such apparatus are used to convert a fluid, such as water, from a liquid to a gas. Thereafter the gas is used to apply pressure to a piston or turbine to convert the pressure associated with the gas into work. After applying pressure to the piston or turbine, the gas is pressurized and/or cooled to convert the fluid back into a liquid. The fluid is thereafter heated to convert the fluid to a gas so the process may be repeated.

A drawback associated with such a prior art compression cycle apparatus, is the efficiency associated with conversion of the heat energy contained within the fluid into work. Although a portion of the heat energy contained within the fluid is converted into work as the fluid expands, the steam exiting prior art motors still contains a substantial amount of energy, from which it would be desirable to obtain additional work.

Another drawback associated with such prior art systems is the energy required to condense the exhaust gas from a gas back into a liquid. Still another drawback associated with prior art systems is unnecessary cooling of exhaust liquid. In prior art compression cycle apparatus, a portion of the gas in contact with cooler parts of the apparatus will often condense into a liquid. This exhaust liquid is cycled, along with the exhaust gas, through the prior art condenser for cooling. As the liquid cycles through the prior art condenser, the liquid is cooled, thereby requiring an additional amount of heat energy to raise the temperature back to the boiling point of the fluid at a later point in the cycle. Additionally, as prior art condensers necessarily extract additional heat energy from the liquid, the energy extraction from the exhaust gas is thereby compromised, requiring a larger prior art condenser to compensate for the unnecessary extraction of additional heat energy from the liquid. Accordingly, all of the energy associated with cooling the exhaust liquid beyond its boiling point is wasted, inasmuch as additional energy will be required at a later point in the compression cycle to raise the temperature of the fluid back to its boiling point. It would, therefore, be desirable to not only more efficiently convert the heat energy associated with the exhaust gas into work, but also to avoid the unnecessary cooling and reheating of the exhaust liquid. The difficulties encountered in the prior art discussed hereinabove are substantially eliminated by the present invention.

SUMMARY OF THE INVENTION

In an advantage provided by this invention, a compression cycle apparatus is provided for increasing the efficiency with which energy is converted into work.

Advantageously, this invention increases the efficiency of the condensation process by limiting cooling of exhaust liquid.

Advantageously, this invention increases the efficiency of the condensation process by increasing the temperature of a liquid prior to its conversion to a gas.

Advantageously, this invention provides for the use of a smaller prior art condenser, thereby reducing the cost, weight and maintenance associated with a larger condenser.

Advantageously, in the preferred example of this invention, a condensation apparatus is provided, comprising a fluid, means for changing the fluid from a liquid to a pressurized gas, means for condensing a portion of the pressurized fluid to a first quantity of liquid, and means for deriving work from the pressurized gas as the pressurized gas condenses to the first quantity of the liquid. In the preferred embodiment, the condensation apparatus provides a condenser and means for directing gas from the condensing means to the condenser. Additionally, means are provided for directing the first quantity of the liquid from the condensing means, away from the condenser.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
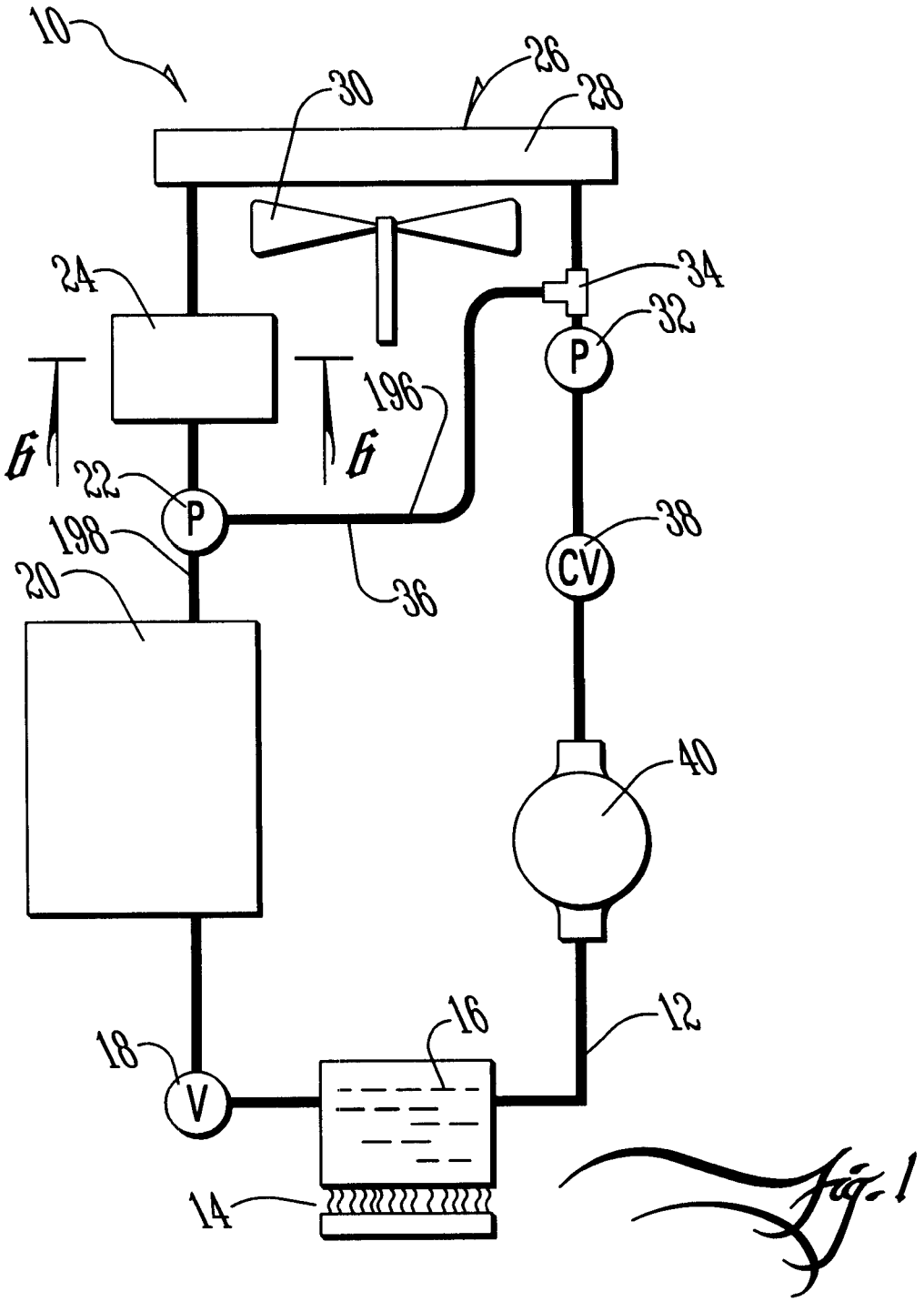
FIG. 1 illustrates a top plan view of the condensation assembly of the present invention.

A fluid condensing apparatus according to this invention is shown generally as (10). The fluid condensing apparatus (10) includes several lengths of insulated pipe (12), which may be constructed of copper, stainless steel, or any suitable material known in the art.

The fluid condensing apparatus (10) is provided with a heater (14), capable of heating a fluid such as water (16). Of course, the fluid may be any suitable fluid known in the art. The heater (14) is coupled by insulated pipe (12) to an injection control valve (18). In the preferred embodiment, the injection control valve (18) is a ball valve, manufactured by Thermal Dynamics of Adel, IA. The injection control valve (18) is coupled by insulated pipe (12) to a fluid motor (20), such as the variable stroke motor described in U.S. Letters Patent number 5,974,943 and incorporated herein by reference, or any other fluid driven motor known in the art. The fluid motor (20) is coupled by insulated pipe (12) to a scavenger pump (22) Although the scavenger pump (22) may be of any type known in the art in the preferred embodiment, the scavenger pump (22) is manufactured by Thermal Dynamics of Adel, IA. Of course, the scavenger pump (22) may be of any type known in the art, suitable for removing a liquid from a fluid.

The scavenger pump (22) is coupled by insulated pipe (12) to a condenser motor (24), which, in turn, is coupled to a condenser (26), comprising a radiator (28) and a fan (30). The condenser (26) is couple by insulated pipe (12) to a fluid pump (32). The fluid pump (32) is manufactured by Thermal Dynamics of Adel, IA. As shown in FIG. 1, the portion insulated pipe (12) extending between the condenser (26) and the fluid pump (32) is provided with a T-joint (34) to which is coupled an insulated bypass pipe (36). The insulated bypass pipe (36) is also coupled to the scavenger pump (22). The fluid pump (32) is coupled by insulated pipe (12) to a back flow check valve (38) and an accumulator (40), such as those well known in the art.

Figure 2:
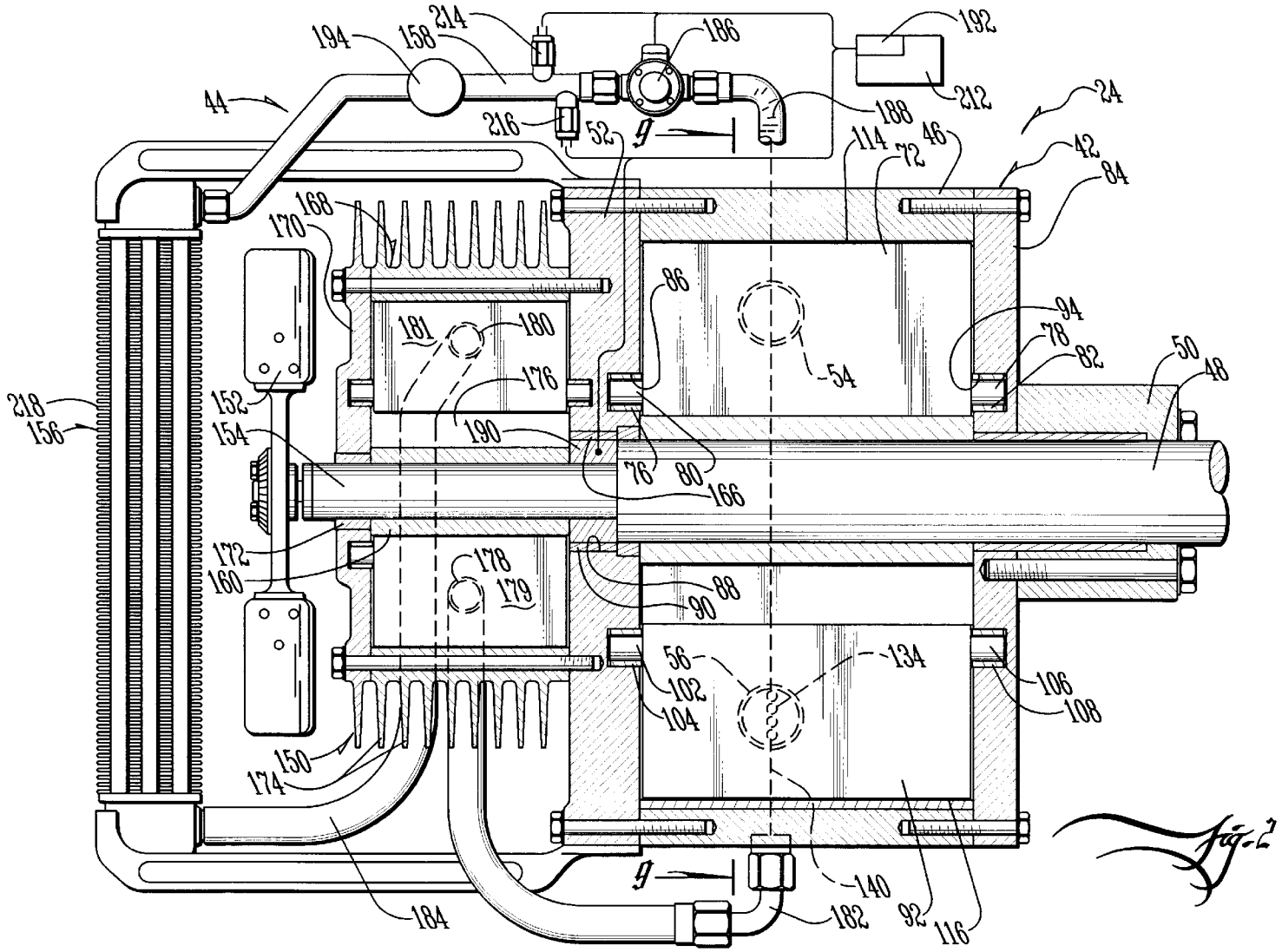
FIG. 2 illustrates a partial phantom bottom view in cross-section of the condenser of the present invention.
Figure 3:
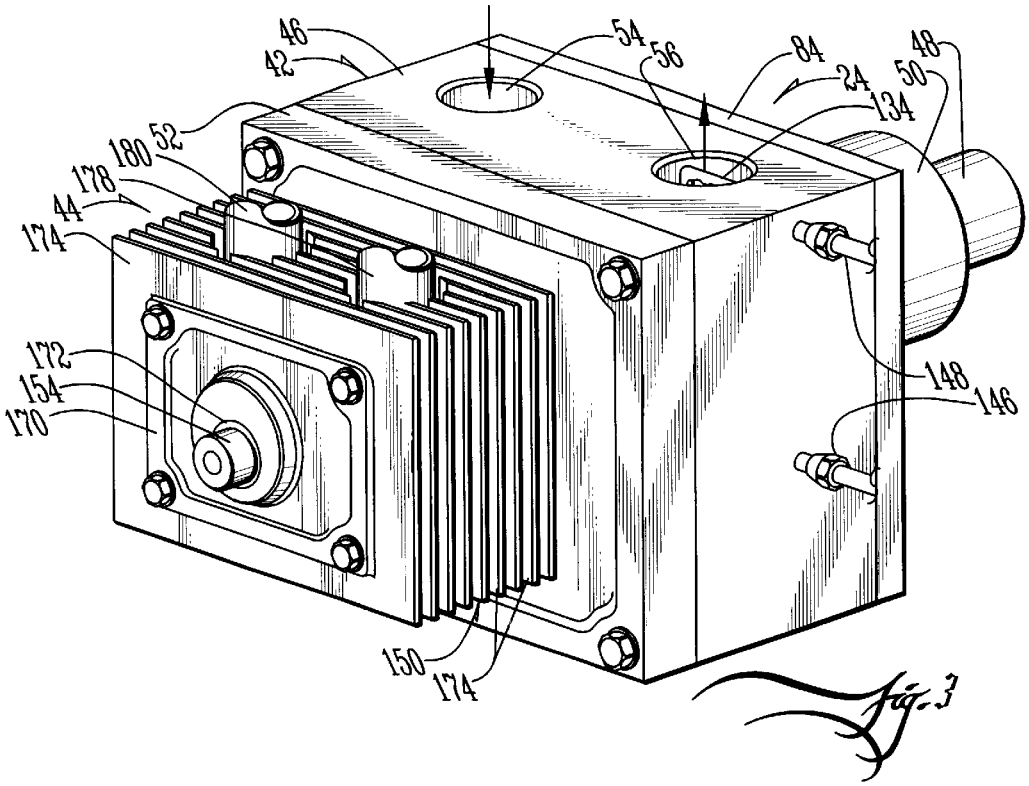
FIG. 3 illustrates a front perspective view of,the condenser of FIG. 1.

As shown in FIG. 2, the condenser motor (24) comprises a motor (42) and a cooling system (44). As shown in FIG. 3, the motor (42) and cooling system (44) are contained within a housing (46). The housing (46) may be constructed of stainless steel or any other suitable material. As shown in FIG. 3, the motor (42) includes a driveshaft (48) coupled to the housing (46) by a bushing (50). The bushing (50) is secured to the housing (46) by bolts or similar securement means.

Figure 4:
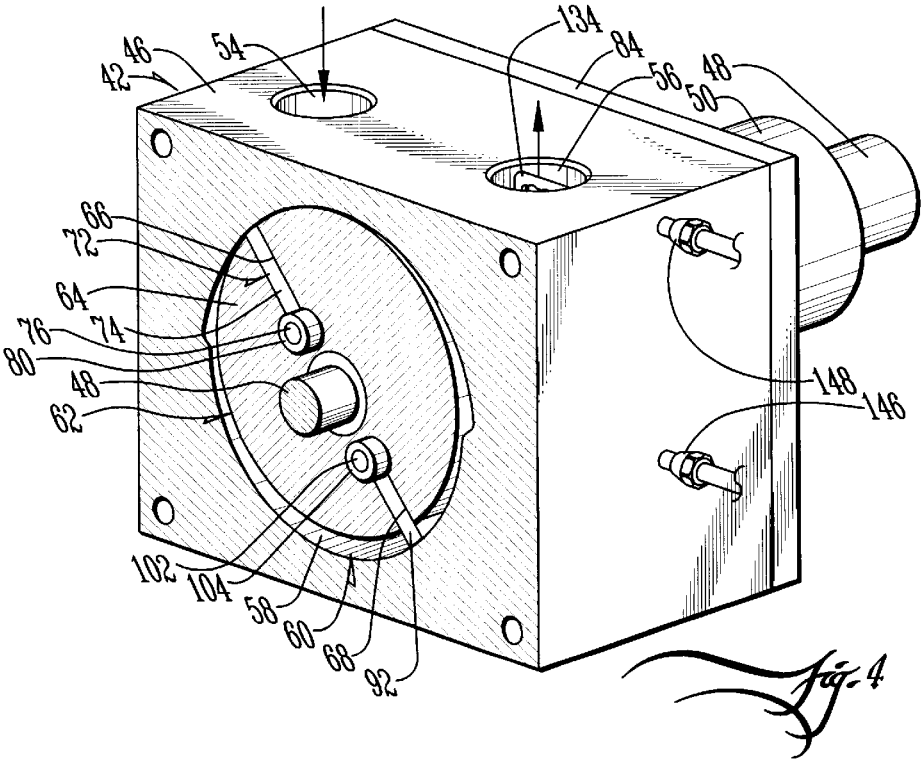
FIG. 4 illustrates a rear perspective view of the condenser of FIG. 1, shown with the cooling assembly removed.

FIG. 4 shows the motor (42) with the cooling system (44) and divider plate (52) removed. (FIGS. 2 and 4). The motor (42) is provided with a fluid inlet (54) and a fluid outlet (56). The housing (46) includes an outer wall (58), defining a hollow interior (60). Provided within the hollow interior (60) is a revolver, which, in the preferred embodiment, is a drum (62), comprising a solid cylinder (64) having a first slot (66) and a second slot (68). The cylinder (64) is welded or otherwise coupled to the driveshaft (48), which extends through the center of the cylinder (64). While the slots (66) and (68) may be of any suitable dimensions, in the preferred embodiment, the slots (66) and (68) are of a symmetrical design and of a constant width, extending across the entire length of the cylinder (64). Provided within the first slot (66) is a plate (70) such as a first vane (72). The plate (70) may, of course, be a piston, a curved vane or any other movable structure known in the art to translate pressure into movement.

Figure 5:
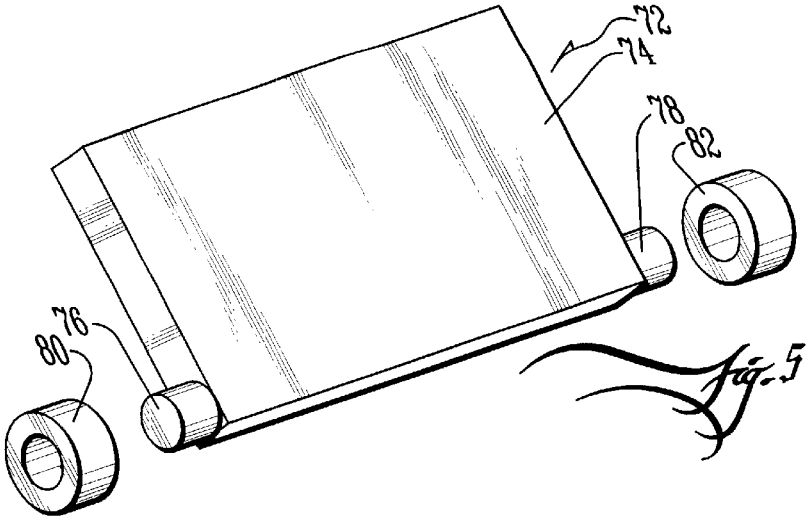
FIG. 5 illustrates a side perspective view of the first vane of the motor of the present invention.

As shown in FIG. 5, in the preferred embodiment, the first vane (72) comprises a rectangular block (74) of stainless steel or similarly rigid material. Secured laterally to the lower end of the block (74) are ears (76) and (78). Preferably the block (74) and ears (76) and (78) are formed of a single piece of stainless steel. The ears (76) and (78) are preferably cylindrical, and each provided with a bearing (80) and (82).

Figure 6:
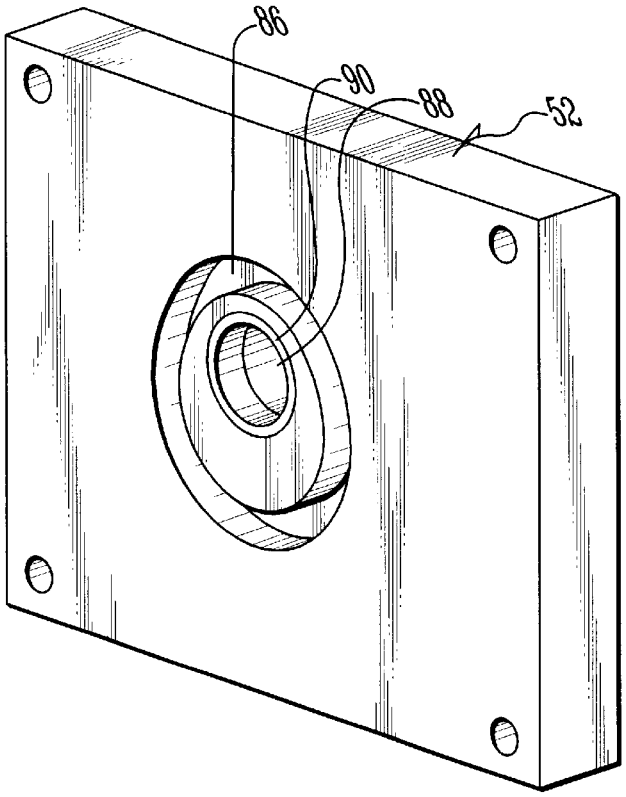
FIG. 6 illustrates a side perspective view of the divider plate of the motor of the present invention.

As shown in FIG. 3, the housing (46) also comprises a front plate (84), which, along with the divider plate (52) is secured over the hollow interior (60) by bolts or similar securement means. (FIGS. 3–4). As shown in FIG. 6, the divider plate (52) is provided with an elliptical groove (86) surrounding a circular throughbore (88). The width and depth of the elliptical groove (86) are slightly greater than the dimensions of the second bearing (82) which rides therein. (FIG. 5–6). Provided within the throughbore (88) is a bushing (90) having an outer diameter substantially similar to the diameter of the throughbore (88) and an inner diameter substantially similar to that of the driveshaft (48). (FIGS. 3 and 6). Although the elliptical groove (86) may be of any suitable depth, in the preferred embodiment it is two centimeters in depth, with the depth of the divider plate (52) being four centimeters.

Figure 7:
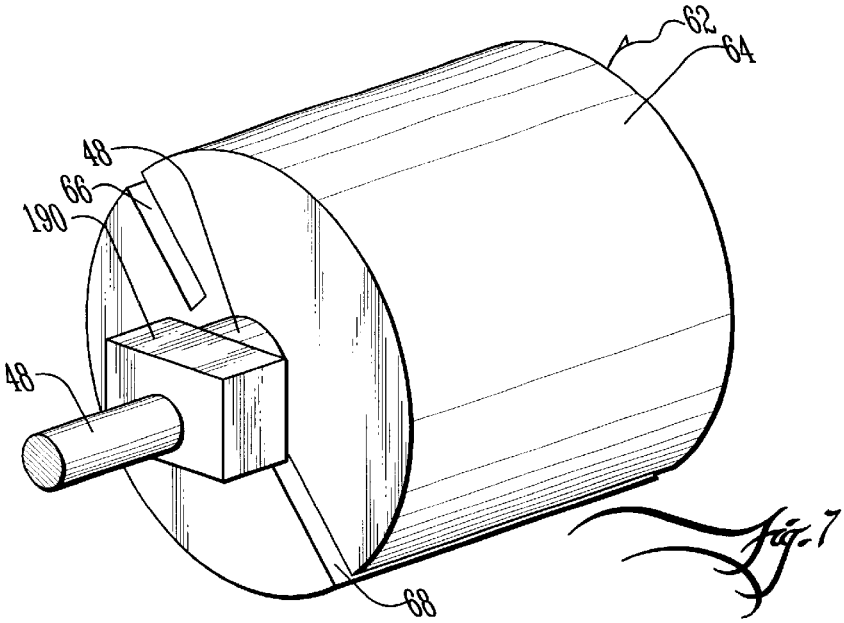
FIG. 7 illustrates a rear perspective view of the cylinder and gearbox of the present invention.
Figure 8:
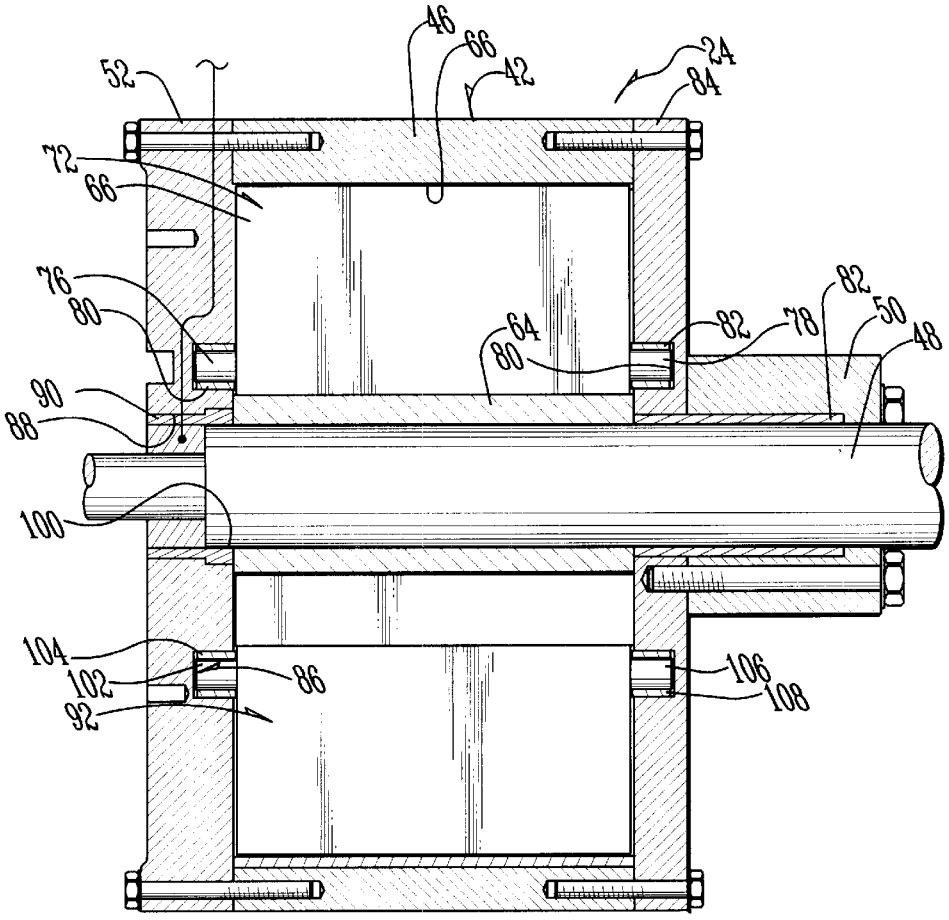
FIG. 8 illustrates a partial phantom side elevation in cross-section of the motor of the condenser of the present invention, taken along Line 6—6 of FIG. 1.

As shown in FIG. 7, the slots (66) and (68) of the cylinder (64) are sized to provide slidable movement of the first vane (72) and a second vane (92) within the slots (66) and (68), relative to the cylinder (64). (FIGS. 7 and 8). As shown in FIG. 8, the front plate (84) is also provided with an elliptical groove (94) and a bushing (96). The front plate (84) is also provided with a throughbore (98), containing the bushing (96) and an open center (100), which allows the driveshaft (48) to pass through the front plate (84). Provided within the elliptical groove (94) is the first bearing (80) provided around the first ear (76). As shown in FIG. 8, the second vane (92) is provided with a third ear (102) and a third bearing (104), provided within the elliptical groove (94) of the front plate (84), and a fourth ear (106) and a fourth bearing (108), provided within the elliptical groove (86) of the divider plate (52).

Figure 9:
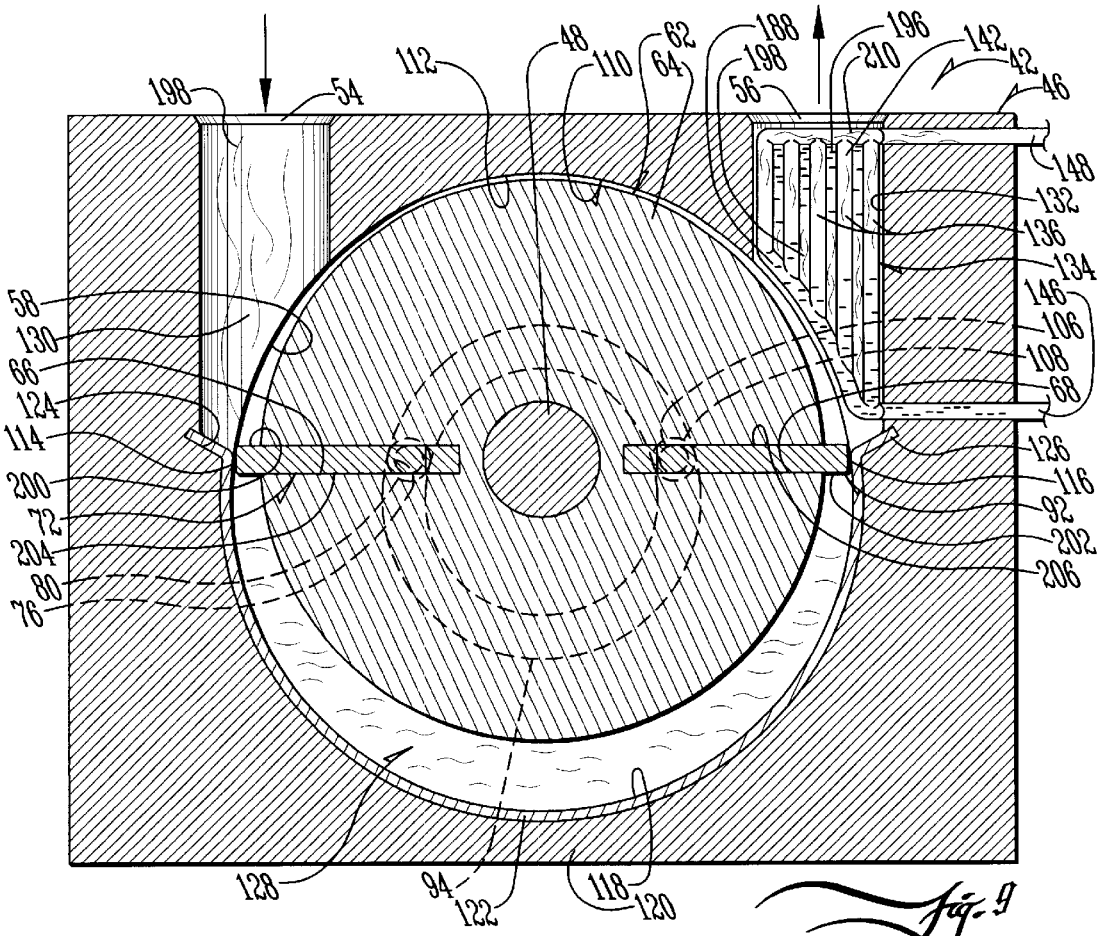
FIG. 9 illustrates a partial phantom front elevation in cross-section of the motor of the present invention taken along Line 9—9 of FIG. 2.

As shown in FIG. 9, the housing (46) is provided with a ceiling (110) having an inner face (112) of a curvature substantially similar to that of the cylinder (64). The cylinder (64) is preferably positioned within five millimeters of, and, more preferably, within one millimeter of the inner face (112) of the ceiling (110). The cylinder (64) is preferably positioned no closer than one one-hundredth of a millimeter, and, more preferably no closer than one-tenth of a millimeter to the inner face (112) of the ceiling (110). In the preferred embodiment, the tips (114) and (116) of the vanes (72) and (92) are constructed of titanium or other abrasion-resistant material to reduce damage associated with particulate (not shown) passing between the tips (114) and (116) and the housing (46) of the motor (42).

As shown in FIG. 9, the outer wall (58) includes not only the face (112) of the ceiling (110), but a face (118) of a floor (120) of the housing (46) as well. The face (118) of the floor (120) is provided with an abrasion plate (122), preferably constructed of titanium or similar abrasion-resistant material. As shown, the housing (46) is provided with a first slot (124) and a second slot (126) to which the ends of the abrasion plate (122) are friction fit. Although the face (118) of the floor (120) may be of any suitable dimensions, in the preferred embodiment the cylinder (64) is of a tighter radius than that of the preferably constant radius of the face (118) of the floor (120). The distance between the cylinder (64) and the abrasion plate (122) is preferably between fifty percent and ninety-five percent of the height of the vanes (72) and (92).

Figure 10:
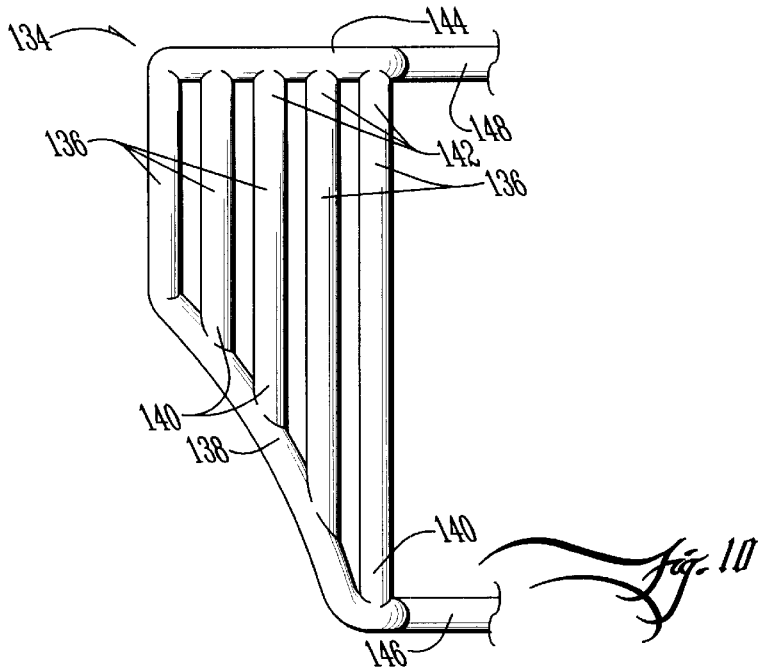
FIG. 10 illustrates a side elevation of the heat exchanger of the present invention
Figure 11:
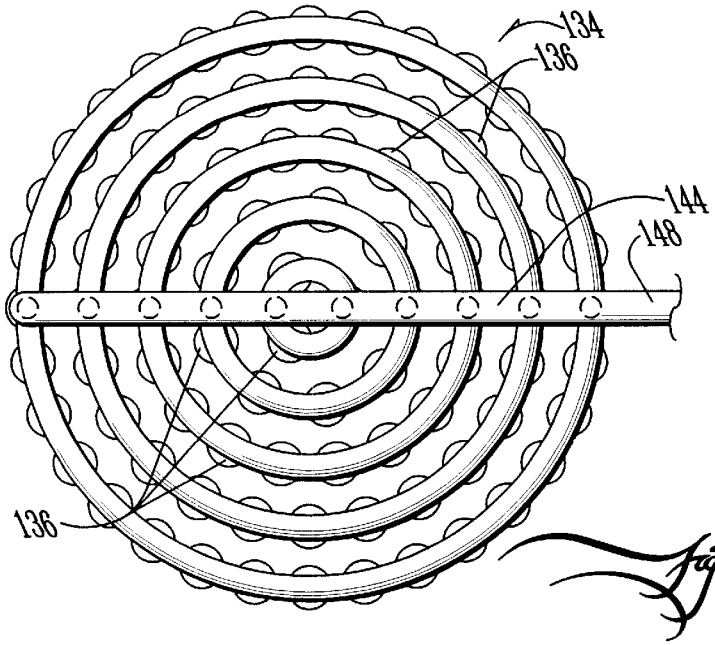
FIG. 11 illustrates a top elevation of the heat exchanger of FIG. 10.

As shown in FIG. 9, the housing (46) defines a chamber (128). The chamber (128) includes an expansion chamber (130) in fluid communication with the fluid inlet (54) and a condensation chamber (132) in fluid communication with both the fluid outlet (56) and the expansion chamber (130). As shown in FIG. 9, provided within the condensation chamber (132) is a heat exchanger (134). As shown in FIGS. 10 and 11, the heat exchanger (134) comprises a plurality of exchange tubes (136). In the preferred embodiment, the exchange tubes (136) are constructed of thin-walled aluminum.

The exchange tubes (136) may, of course, be constructed of any suitable material, preferably designed to increase the surface area of the exchange tubes (136) within the interior of the condensation chamber (132). As shown in FIG. 10, the exchange tubes (136) are of varying lengths, to accommodate the dimensions of the condensation chamber (132), shown in FIG. 9. Of course, the exchange tubes (136) may be constructed of any desired dimensions. The exchange tubes (136) are preferably provided with lower link tubes (138) in fluid communication with the bottoms (140) of the exchange tubes (136). Similarly, the tops (142) of the exchange tubes (136) are coupled into fluid communication with upper link tubes (144). Preferably the lower link tubes (138) and upper link tubes (144) are constructed of thin-walled aluminum and allow fluid to circulate evenly through the exchange tubes (136). As shown in FIG. 10, the lower link tubes (138) are coupled into fluid communication with an inlet (146) and the upper link tubes (144) are coupled into fluid communication with an exhaust (148). As shown in FIG. 9, the heat exchanger (134) may rest on the abrasion plate (122), or may instead be friction fit or otherwise secured into the condensation chamber (132).

As shown in FIG. 2, the cooling system (44) is coupled to the divider plate (52) of the motor (42) by bolts or similar securement means. As shown in FIG. 2, the cooling system (44) is provided with a compressor (150) substantially similar to the motor (42), albeit on a smaller scale. In the preferred embodiment, the components of the compressor (150) are twenty-five percent of the dimensions of the motor (42) but may, of course, be of any suitable dimensions relative to the motor (42), including, but not limited to, being larger than the components of the motor (42). As shown in FIG. 2, the cooling system (44) comprises the compressor (150), a fan blade (152) coupled to a compressor driveshaft (154), a radiator (156), and insulated tubing (158).

Figure 12:
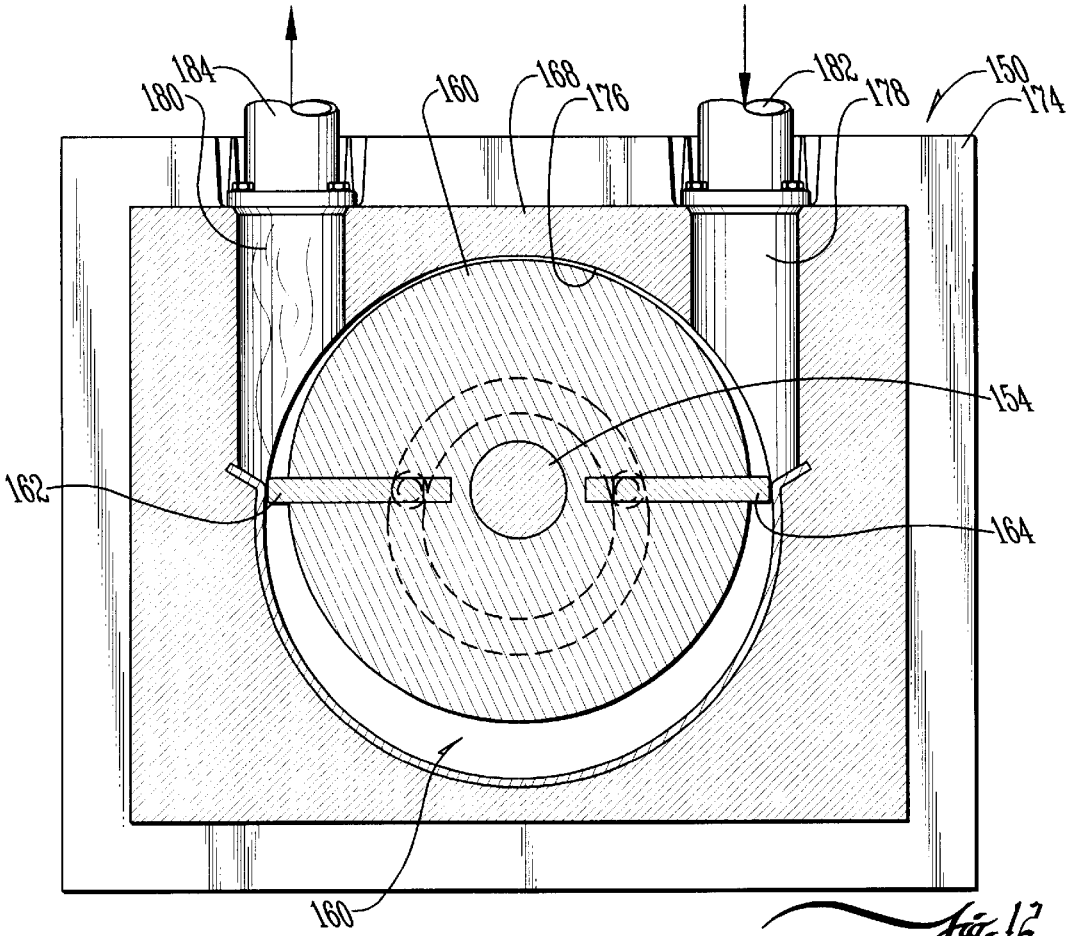
FIG. 12 illustrates a partial phantom front elevation in cross section of a portion of the cooling system compressor of the present invention.

As shown in FIG. 12, the compressor (150) is constructed in a manner similar to that described above in relationship to the motor (42), albeit on a smaller scale. As shown in FIG. 12, the compressor (150) comprises a drum (160), provided with a first vane (162) and second vane (164). The drum (160) is provided around the compressor driveshaft (154), which, as shown in FIG. 2, is journaled within a bushing (166) provided within the divider plate (52). Also shown in FIG. 2, the compressor driveshaft (154) extending through the compressor (150) is of a narrower diameter than the driveshaft (48) passing through the motor (42). Preferably the compressor driveshaft (154) is one-half the diameter of the driveshaft (48) passing through the motor (42).

The compressor (150) is provided with a housing (168) and a back plate (170), which is bolted or otherwise secured to the housing (168). The back plate (170) is provided with a bushing (172), through which the compressor driveshaft (154) is secured. As shown in FIG. 12, the housing (168) is preferably provided with aluminum fins (174), such as those well known in the art, to dissipate heat away from the housing (168). The compressor (150) is also provided with a chamber (176), divided into an input chamber (178) and a compression chamber (180). As shown in FIGS. 2, 9 and 12, the exhaust (148) of the heat exchanger (134) is coupled into fluid communication with the input chamber (178) of the compressor (150) by high pressure tubing (182). Similarly, the compression chamber (180) is coupled into fluid communication with the radiator (156) by an additional piece of high pressure tubing (174). The radiator (156) is coupled into fluid communication with the inlet (146) of the heat exchanger (134). As shown in FIG. 2, a valve (186), which is, in the preferred embodiment, a ball check valve, manufactured by Thermal Dynamics of Adel, IA, or any other similar valve known in the art of fluid compression and expansion systems, is provided to provide a sufficient amount of back pressure to allow a fluid (198), such as dichlorodifluoromethane, provided in the cooling system, to liquefy prior to entering the heat exchanger (134).

As shown in FIG. 7, the driveshaft (48) is provided with a gearbox (190), such as those known in the art, to engage and disengage the compressor driveshaft (154) coupled to the fan blade (152), depending on the cooling requirement of the radiator (156). As shown in FIG. 7, the gearbox (190) is coupled to an electronic control mechanism (192), capable of signaling the gearbox (190) to either engage or disengage the compressor driveshaft (154), or to increase or decrease rotation of the compressor driveshaft (154) relative to the driveshaft (48) extending into the motor (42). The cooling system (44) is also provided with an accumulator (194) coupled between the radiator (156) and the heat exchanger (134) to store fluid (198) which has passed through the compressor (150) and radiator (156).

To operate the fluid condensing apparatus (10) in accordance with the present invention, the heater (14) is actuated to heat the water (16) to a temperature of two hundred fifty degrees Celsius, at a pressure of three hundred pounds per square inch. (FIG. 1) The injection control valve (18) is actuated to allow the hot water (16) into the fluid motor (20), where the fluid motor (20) converts the pressurized water (16) into pressurized steam, and the pressurized steam into work. Thereafter, the water (16) exits the fluid motor (20) and enters the scavenger pump (22), which separates liquid water (196) from steam (198) and directs the liquid water (196) around the condenser (16) to the fluid pump (32). Preferably, the fluid motor (20) is a plurality of fluid motors such as that described in U.S. Letters patent number 5, 974,943 so as to allow a portion of steam (198) to condense to liquid water (196) as the fluid motor (20) converts the heat energy associated therewith into work. This allows the liquid water (196) to avoid being cooled in the condenser (26) and reheated by the heater (14). Alternatively, the scavenger pump (22) may be positioned between the condenser motor (24) and the condenser (26) to direct an even larger quantity of liquid water (196) around the condenser (26). The water (16) enters the fluid condensing apparatus (10) in the form of liquid water (196) at a temperature of one hundred degrees Celsius, and steam (198), at a temperature of one hundred and two degrees Celsius. As the liquid water (196) and steam (198) enter the inlet (48) of the motor (42), the pressurized steam (198) presses against a face (200) of the first vane (72), forcing the first vane (72) and cylinder (64) into a counterclockwise rotation. The pressurized steam (198) continues to expand and to press on the face (200) of the first vane (72) until the vanes (72) and (92) are in the orientation shown in FIG. 13.

Figure 13:
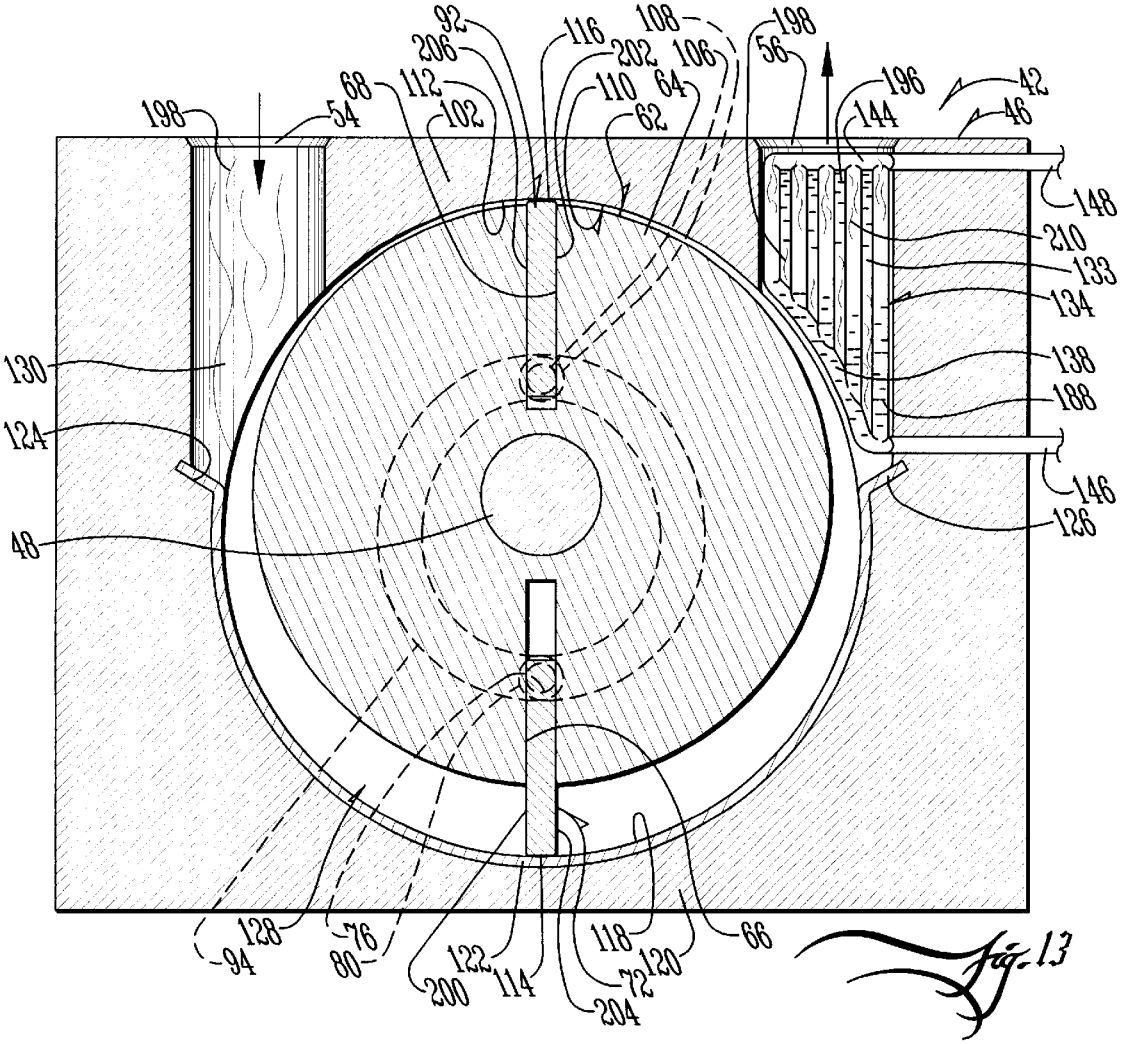
FIG. 13 illustrates the motor of FIG. 9, shown with the vanes rotated ninety degrees.

As shown in the drawings, the elliptical grooves (78) and (86) guide the bearings (72), (74), (96) and (100) along a path sufficient to maintain the tips (114) and (116) of the vanes (72) and (92) near, but just out of contact with, the inner face (112) of the ceiling (110) and the abrasion plate (122). (FIGS. 8 and 13). As shown in FIG. 13, when the first vane (72) is nearly fully extended out of the first slot (66), the second vane (92) is retracted into the second slot (68). The amount of the second vane (92) exposed to the pressurized steam (198) is, therefore, reduced, as is its drag coefficient. If the second vane (92) were instead extended, it would have a larger drag coefficient, and would allow the pressurized steam (198) to force the cylinder (64) toward a clockwise rotation, reducing the efficiency of the motor (42).

As shown in FIG. 13, as the pressurized steam (198) presses against the face (200) of the first vane (72), the tip (106) of the first vane (72) moves along the abrasion plate (122). The gap between the tip (106) of the first vane (72) and the abrasion plate (122) is preferably less than five millimeters, and, more preferably, less than one millimeter; while being preferably greater than one one-hundredth of a millimeter, and more preferably, more than one fiftieth of a millimeter in length.

Figure 14:
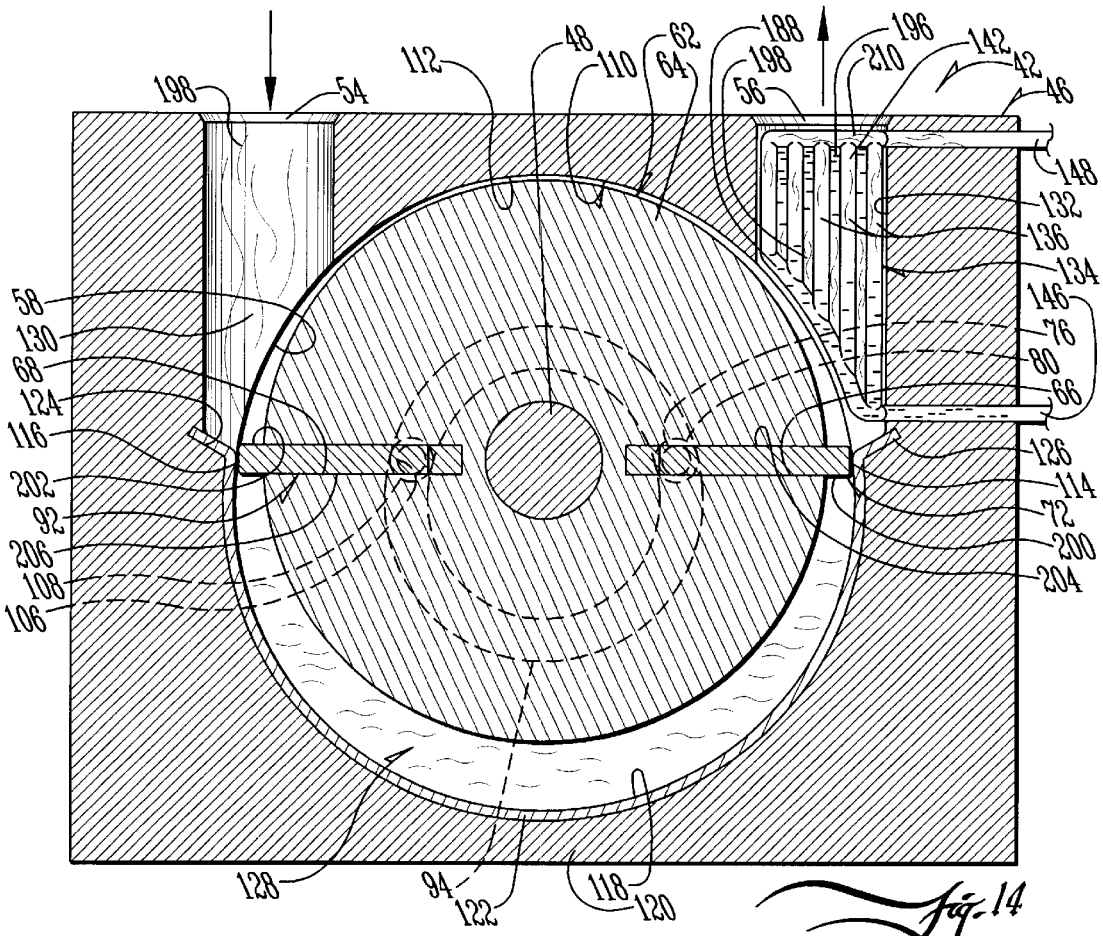
FIG. 14 illustrates the motor of FIG. 9, shown with the vanes rotated one hundred eighty degrees.

As the pressurized steam (198) presses against the face (200) of the first vane (72), the first vane (72) rotates the cylinder (64) and driveshaft (42). As the cylinder (64) rotates toward the orientation shown in FIG. 14, the elliptical grooves (78) and (86) force the bearings (96) and (100) to move the second vane (92) out of the second slot (68) to expose a face (192) of the second vane (92) to the pressurized steam (198). (FIGS. 8 and 14). Similarly, the elliptical grooves (78) and (86) guide the bearings (72) and (74) of the first vane (72) to retract the first vane (72) into the first slot (66), thereby reducing the amount of the face (200) of the first vane (72) exposed to the pressurized steam (198). This cycle continues with the elliptical groove (86) of the divider plate (52) and elliptical groove (86) of the front plate (84), guiding the bearings (72), (74), (96) and (100) to extend and retract the first vane (72) and second vane (92), reducing the exposure of the faces (200) and (202) of the vanes (72) and (92) as they pass the inner face (112) of the ceiling (110), and increasing the exposure of the faces (200) and (202) of the vanes (72) and (92) as they pass the abrasion plate (122).

The elliptical grooves (78) and (86) also prevent the tips (114) and (116) of the vanes (72) and (92) from contacting the housing (46) for the abrasion plate (122), which would cause friction, reducing both the efficiency and life span of the motor (42). As the vanes (72) and (92) move past the abrasion plate (122), the pressurized steam (198) enters the condensation chamber (132). (FIG. 14). As shown in FIG. 14, as the pressurized steam (198) enters the heat exchanger (134) provided in the condensation chamber (132), the pressurized steam (198) contacts the exchange tubes (136) which extract heat from, and thereby condense, the steam (198) into liquid water (196).

As the steam (198) condenses to liquid water (196), the volume of the steam (198) is reduced, thereby creating a negative pressure within the condensation chamber (132). This negative pressure exerts a counterclockwise force on a rear face (204) of the first vane (72), and a rear face (206) of the second vane (92) as the cylinder (64) rotates. In the preferred embodiment of the present invention, the motor (42) converts at least fifty percent, more preferably seventy-five percent, and most preferably ninety percent, of the steam (198) entering the motor (42) into liquid water (196) before the water (16) exits the condensation chamber (132) and passes to the prior art condenser (26) through the insulated pipe (12). (FIGS. 1 and 14). Preferably, the low pressure generated by the condensing steam (198) provides at least ten percent, more preferably at least twenty-five percent, and most preferably at least forty percent of the work required to rotate the drive shaft.

To condense the steam (198) within the condensation chamber (132), the exchange tubes (124) allow heat to pass from the steam (198) into the fluid (198) passing within the exchange tubes (136). In the preferred embodiment, the fluid (198) within the exchange tubes (136) is a liquid (208) as it enters the heat exchanger (134) and is converted to a gas (210), as the fluid (198) moves through the heat exchanger (134) and extracts heat from the steam (198) within the condensation chamber (132). From the heat exchanger (134), the gas (210) passes through the upper link tubes (144) and out the exhaust (148) to pass through the high-pressure tubing (182) into the input chamber (178) of the compressor (150).

As the motor (42) turns the driveshaft (48), the compressor driveshaft (154) rotates the drum (160), causing the vanes (152) and (154) to rotate, alternately extending from, and retracting into, the drum (160). In the preferred embodiment, the valve (186) is set to maintain pressure in the cooling system (44) between the valve (186) and the compressor (150). Accordingly, as the drum (160) rotates, the vanes (152) and (154) push the gas (210) from an area of lower pressure, namely the input chamber (178), to an area of higher pressure, namely the compression chamber (180). As the gas (210) is compressed, it converts into a liquid and generates heat, some of which is preferably radiated out through the fins (174) secured to the compressor (150). The electronic control mechanism (192) is also preferably coupled to the valve (186) to open the valve (186) more or less, and to increase, decrease or stop the rate of rotation of the compressor driveshaft (154) depending on the amount of liquid (208) required to cool the steam (198) passing through the condensation chamber (142) of the motor (42).

In the preferred embodiment, the electronic control mechanism (192) is a personal computer (212) coupled to a plurality of pressure gauges (214) and temperature gauges (216) provided at different areas throughout the fluid condensing apparatus (10). The personal computer is programmed to automatically condense more gas (210) into liquid (98) upon receipt of information from the pressure gauges (214) and temperature gauges (216), indicating that predetermined set points have been reached, and it is desired to produce more or less liquid (208), or to stop production of the liquid (208) all together.

As the rotating vanes (152) and (154) continue to convert the gas (210) into a liquid (208), the liquid (208) exits the compression chamber (180) and passes through the high-pressure tubing (174), into the radiator (156). As shown in FIG. 2, the radiator (156) is preferably provided with fins (218) in a manner such as that well known in the art. The radiator (156) and fins (218) are preferably positioned relative to the fan blade (152) in an orientation which allows the fan blades (144) to cool the radiator (156). As the compressor driveshaft (154) rotates, the fan blades (144) circulate air over the fins (218) of the radiator (156), removing heat from the liquid (208) passing through the radiator (156). As the liquid (208) cools, it moves out of the radiator (156) into the accumulator (194), where it remains until the personal computer (212) opens the valve (186) opens sufficiently to return the liquid (208) to the inlet (146) of the heat exchanger (134), whereafter the process described hereinabove is repeated.

As the fluid (198) circulates through the cooling system (44), the steam (198) passing through the motor (42) condenses to liquid water (196), causing a vacuum, which, along with the pressure of the steam (198) expanding in the expansion chamber (130), causes the vanes (72) and (92) to rotate in a counterclockwise manner, thereby translating expansion and condensation of the steam (198) into rotational motion of the driveshaft (48) which may be used to produce electricity, or for any other desired type of work.

Although the fluid condensing apparatus (10) may be constructed of any suitable material, in the preferred embodiment, the housing (46) for the motor (42) and the housing (168) of the compressor (150) are constructed out of stainless steel, as are the vanes (64), (84), (152) and (154), and drums (56) and (150). High abrasion areas, such as the tips (114) and (116) of the vanes (72) and (92), and the abrasion plate (122), are constructed of titanium or similar abrasion resistant material. All of the other components are constructed from materials known in the art suitable for the purposes described herein. Of course, the fluid condensing apparatus (10) may be constructed of aluminum, iron, brass, plastic or any other material known in the art, and may be constructed of any suitable configuration or dimensions, from several angstroms to several meters in length. Preferably, the fluid condensing apparatus (10) is constructed of a block, approximately one cubic centimeter to one cubic meter in size, and, more preferably twenty-five cubic centimeters to one-half cubic meter in size. In the preferred embodiment, the first vane (72) is seven centimeters long, seven and one-half centimeters wide, and one centimeter thick. The diameter of the drum (62) is fifteen centimeters, and the distance between the inner face (112) of the ceiling (110) and the abrasion plate (122) along a line through the center of the drum (62) is sixteen and one-half centimeters.

Although the invention has been described with respect to a preferred embodiment hereof, it to be also understood that it is not so limited, since changes and modifications can be made therein which are within the full intended scope of this invention, as defined by the appended claims.

What is claimed is:

1. A condensation apparatus comprising:

(a) a fluid;

(b) means for changing said fluid from a liquid to a pressurized gas;

(c) means for deriving work from said pressurized gas as said pressurized gas condenses;

(d) a shaft; and (e) means coupled to said shaft for rotating said shaft and for converting said work into at least ten percent (10%) of the energy used to rotate said shaft.

2. The condensation apparatus of claim 1, further comprising:

(a) a condenser;

(b) means for directing said gas from said condensing means to said condenser; and (c) means for directing said first quantity of said liquid from said condensing means away from said condenser.

3. The condensation apparatus of claim 2, further comprising means for directing a second quantity of liquid condensed by said condenser from said condenser to said changing means.

4. The condensation apparatus of claim 3, wherein said means for directing said first quantity of said liquid is means for directing said first quantity of said liquid from said condensing means to said changing means.

5. The condensation apparatus of claim 2, wherein said means for directing said first quantity of said liquid is means for directing said first quantity of said liquid from said condensing means to said changing means.

6. The condensation apparatus of claim 1, wherein said condensing means comprises means for cooling a sufficient amount of said pressurized gas to generate a sufficient negative pressure upon a plate to assist in movement of said plate.

7. The condensation apparatus of claim 1, wherein said condensing means condenses at least twenty percent of said pressurized gas to said first quantity of said liquid.

8. The condensation apparatus of claim 1, wherein said condensing means condenses at least fifty percent of said pressurized gas to said first quantity of said liquid.

9. The condensation apparatus of claim 1, wherein said condensing means condenses at least sixty percent of said pressurized gas to said first quantity of said liquid.

10. The condensation apparatus of claim 1, wherein said condensing means condenses at least seventy percent of said pressurized gas to said first quantity of said liquid.

11. A condensation apparatus comprising:

(a) a fluid;

(b) means for changing said fluid from a liquid to a pressurized gas;

(c) a housing defining a chamber;

(d) a plate provided within said chamber;

(e) means for directing said pressurized gas into said chamber;

(f) means for condensing at least a portion of said gas sufficiently to provide at least ten percent (10%) of the energy used to move said plate;

(g) means for directing said gas from said condensing means to a condenser;

(h) means for directing a first quantity of liquid condensed by said condensing means away from said condenser and toward said changing means;

(i) means for directing a second quantity of liquid condensed by said condenser toward said changing means;

(j) a shaft; and (k) means coupled to said shaft for rotating said shaft wherein work provided by said gas condensing provides at least ten percent (10%) of the energy used to rotate said shaft.

12. The condensation apparatus of claim 11, wherein said condensing means condenses at least twenty percent of said pressurized gas to said first quantity of said liquid.

13. The condensation apparatus of claim 11, wherein said condensing means condenses at least fifty percent of said pressurized gas to said first quantity of said liquid.

14. The condensation apparatus of claim 11, wherein said condensing means condenses at least a sufficient amount of said pressurized gas to said first quantity of said liquid to create a sufficient area of reduced pressure to provide at least thirty percent of the work necessary to move said plate.

15. The condensation apparatus of claim 11, wherein said condensing means condenses at least a sufficient amount of said pressurized gas to said first quantity of said liquid to create a sufficient area of reduced pressure to provide at least fifty percent of the work necessary to move said plate.

16. A condensation apparatus comprising:

(a) a fluid;

(b) means for changing said fluid from liquid to a high-pressure gas;

(c) means for converting expansion of said high-pressure gas into work;

(d) means for converting condensation of said high-pressure gas into work;

(e) a condenser;

(f) means for directing a low-pressure gas from said converting means to said condenser;

(g) means for directing a first quantity of liquid from said converting means to said changing means;

(h) means for directing a second quantity of liquid from said condenser to said changing means;

(i) a shaft; and (j) means coupled to said shaft for rotating said shaft wherein work provided by said gas condensing provides at least ten percent (10%) of the energy used to rotate said shaft.

17. The condensation apparatus of claim 16, wherein said condensing means condenses at least twenty percent of said pressurized gas to said first quantity of said liquid.

18. The condensation apparatus of claim 16, wherein said condensing means condenses at least fifty percent of said pressurized gas to said first quantity of said liquid.

19. The condensation apparatus of claim 16, wherein said condensing means condenses at least sixty percent of said pressurized gas to said first quantity of said liquid.

20. The condensation apparatus of claim 16, wherein said condensing means condenses at least seventy percent of said pressurized gas to said first quantity of said liquid.

* * * * *